United States Patent [19]

Fisch et al.

[11] 3,960,565

[45] June 1, 1976

[54] SILVER BLEACHING SOLUTIONS

[75] Inventors: Richard S. Fisch; Norman Newman, both of St. Paul, Minn.

[73] Assignee: Minnesota Mining and Manufacturing Company, St. Paul, Minn.

[22] Filed: Nov. 12, 1973

[21] Appl. No.: 414,890

[52] U.S. Cl. ..... 96/60 R; 96/55; 75/118 P

[51] Int. Cl.[2] ..... G03C 5/32; G03C 7/00; C22B 11/00

[58] Field of Search ..... 96/60 R; 423/367, 493; 75/558, 118 P

[56] References Cited

UNITED STATES PATENTS

| | | | |
|---|---|---|---|
| 2,662,014 | 12/1953 | Umberger | 96/60 R |
| 2,814,565 | 11/1957 | Long | 96/60 R |
| 3,042,520 | 7/1962 | Johnson | 96/60 R |
| 3,256,092 | 6/1966 | Means | 96/60 R |
| 3,592,649 | 7/1971 | Parsonage et al. | 96/60 R |
| 3,770,437 | 11/1973 | Brugger et al. | 96/60 R |
| 3,806,343 | 4/1974 | Millard et al. | 96/60 R |

OTHER PUBLICATIONS

Def. Publn., T910,002, Hotter, May 1, 1973, 96/60 R.

*Primary Examiner*—Mary F. Kelley
*Attorney, Agent, or Firm*—Alexander, Sell, Steldt & Delahunt

[57] ABSTRACT

Aqueous, non-fixing solutions which have a high efficiency in the removal of silver from a water-penetrable mass are comprised of:

1. a water-soluble ferric compound,
2. halide ion, and
3. a water-soluble compound which releases an inorganic ion and increases the redox potential at constant pH of a solution of (1) and (2).

16 Claims, No Drawings

SILVER BLEACHING SOLUTIONS

In the color photographic developing process, it is necessary to remove the silver image residue of the silver halide originally in the photographic emulsion. This is accomplished by photographic bleaching or oxidizing agents such as ferricyanide, which are toxic. Ferricyanide, however, is a fast acting, inexpensive bleaching agent for which suitable alternative materials have not been found in the photographic process. It would therefore be desirable to find alternative bleach solutions which are capable of oxidizing silver trapped within masses penetrable by an aqueous phase such as photographic film.

It is one aspect of this invention to describe a process for the removal of silver from materials containing silver therein.

It is one aspect of this invention to describe chemical solutions useful for the removal of silver from materials.

It is a further aspect of this invention to describe certain novel photographic bleach solutions.

In the color photographic art, a standard process for development of color photographic images comprises:

1. exposing a color coupler containing sensitized silver halide emulsion to light,
2. reducing light exposed, developmentally sensitized silver halide grains to silver metal and allowing the oxidized reducing agent (developer) and color coupler to combine forming a dye,
3. bleaching or oxidizing the metallic silver in the photographic element to an ionic form, and
4. forming a water-soluble complex of the bleached silver to take the silver into solution so that a colored dye image is viewable.

It is apparent that this development process is a process for the removal of silver from a waterpenetrable mass containing silver. The concept of using photoprocessing type solutions to remove silver from all materials which enable contact between an aqueous phase and silver contained within the mass is thus already proven workable by photoprocessing techniques.

It is known that one can use photographic type bleach solutions which are effective in the process of removing silver from a mass or matrix that allows contact between an aqueous phase and silver contained within the mass or matrix (see U.S. Pat. No. 3,733,256). Such water-penetrable materials include photographic elements, ore tailings, printed circuits (with the resinous insulative covering of the metal removed), etc.

It has been found that the chemical bleaching solutions generally useful as photographic bleach solutions in color photographic processing are also useful for the removal of silver from water-penetrable materials in the practice of this invention.

Ferric compounds (e.g., ferric salts) are among those materials known in the photographic art as oxidants; however, the use of ferric compounds as oxidants or bleaches has in the photographic art for the most part (excepting ferricyanide) been limited to bleach-fix baths because of the weak oxidizing strength of such materials. Ferric compounds, such as ferric halide (e.g., especially ferric chloride), ferric nitrate and ferric oxalate, require the presence of fixing agents in order for the silver to be extracted into solution in a reasonable period of time (cf. U.S. Pat. Nos. 3,615,507 and 3,189,452). These ferric salts would be desirable for use in the removal of silver from water-penetrable masses because of economic and environmental considerations were it not for the slow bleaching rate of such materials.

It has been found according to the practice of the present invention that bleaching solutions of one or more of any water-soluble ferric compound which when in solution make ferric ion available for the oxidation of silver (e.g., salts, chelates or complexes) may be formulated which in the absence of effective amounts of fixing agents (silver halide solvents or solubilizing agents) are capable of bleaching silver at rates compatible with commercial requirements for photographic processes and other processes for the removal of silver from water-penetrable masses.

It has been found that the oxidation rate of water-soluble ferric compound oxidizing baths is increased by the addition of water-soluble compounds which release an inorganic ion and which increases the oxidation potential of said bath by at least 50 millivolts in a concentration not exceeding 50 grams/liter and which compound does not render the bath unstable.

The solutions of this invention which have been found to be effective in the oxidizing or photographic bleaching of silver entrapped within a waterpenetrable mass may be described as follows:

An aqueous solution comprising:

1. a water-soluble ferric compound (e.g., ferric chloride or ferric ethylenediaminetetraacetic acid),
2. halide ion (e.g., chloride and bromide), and
3. a water-soluble compound which releases an inorganic ion in aqueous solution and which increases the oxidation potential of the solution at constant pH by at least 50 millivolts when in a concentration not exceeding 50 grams per liter. These may be inorganic compounds or inorganic ions associated with organic radicals. The ferric ion supplied to the solution should be present in the solution in a concentration of at least 0.010 Molar and up to its solubility limit. The minimum concentration of halide ion should be 0.05 Molar and up to a maximum of its solubility limit. The inorganic ion releasing compound should be present in a molar ratio of the inorganic ion releasing compound to the ferric ion of at least 0.10 and up to the solubility limit of the ion.

The aqueous solution does not require a silver halide fixing or solubilizing agent, and any pH range may be used although 0.25 – 9.0 is the preferred range. The additive should be selected so as to not render the solution unstable (e.g., cause precipitation or decomposition within the solution) at the process operating temperatures, normally room temperature.

The oxidation potentials of all solutions were determined by using a platinum indicating electrode and a double junction reference electrode.

The object of the process is to eventually convert the silver to silver halide. Where the silver in the penetrable mass is already in that form (silver halide), it may be directly removed from the mass without conversion. "Green" photographic film (undeveloped radiographic film for example) need not be reduced to convert the silver halide to silver for example.

The process sequence of the present invention where the silver is not in the form of silver halide may be generally described as first assuring that silver trapped within a water-penetrable mass is converted to metallic silver. This is accomplished by contacting the waterpenetrable mass with a reducing agent such as a photographic developer hydroquinone or a tertiary borane amine (tert. butylamine borane). The mass containing metallic silver is then contacted with the oxidizing solutions described above which oxidize or convert the metallic silver to an ionic form of the silver, usually silver halide. Silver halide within the water-penetrable mass can be extracted into solution by using a photoprocessing fixing solution, i.e., a solution containing a material which helps dissolve or solubilize the silver halide and takes the ionic silver into solution. Silver which is taken out of any of the penetrable mass by any of the treating solutions (especially the fixing solution which contains the greatest quantities of silver) may be recovered by any known silver recovery techniques such as replacement, ion exchange, electrolysis, oxidation, etc. (cf. copending U.S. Application Ser. No. 290,972, filed Sept. 21, 1972); however, electrolysis is a preferred method of recovery. Water-penetrable masses which contain silver in a free metal state obviously need not be subjected to the initial reducing steps.

A reading of the following examples will assist in the further understanding of the present invention.

EXAMPLE 1

An aqueous bleach bath was prepared having the following composition:

| | |
|---|---|
| Monosodium-Ethylenediaminetetraacetoferrate (III) | 80 g/l |
| Disodium-Ethylenediaminetetraacetate dihydrate | 30 g/l |
| KBr | 180 g/l |

Various materials were added to the solution to determine their effects upon the oxidation potential of the solution. After the addition of these materials, the pH was adjusted to 4.15 (with sulfuric acid or sodium hydroxide) and the solution diluted to twice the original volume prior to the addition of the various materials. The change in redox potential was measured by a platinum indicating electrode and a double junction reference electrode (Orion No. 90–02) on a Corning 112 pH meter in the millivolt mode.

The results are as follows:

| Solution Additive | Concentration of Additive | Change in Redox Potential |
|---|---|---|
| Control | — | — |
| Thiourea | 5 | 0 |
| Magnesium Sulfate | 5 | 0 |
| Hydroxylamine Sulfate | 5 | −2 |
| Thiosemicarbazide | 3 | −4 |
| 2,5-Dithiobiurea | 5 | 0 |
| Ceric Ammonium Nitrate | 5 | +575 |
| Sodium Chlorate | 5 | +65 |
| Cupric Sulfate | 5 | +40 |
| Sodium Perchlorate | 5 | +60 |
| Potassium Selenocyanate | 5 | −5 |
| Sodium Hypochlorite | 25 gm (5% solution | +675 |
| Potassium Persulfate | 5 | +570 |
| Potassium Iodate | 5 | +70 |
| Potassium Iodide | 17 | +07 |
| Potassium Dichromate | 5 | +375 |
| Nitrosophenol | 5 | −07 |
| Titanium Tetrachloride (EDTA) | 5 | +165 |
| Iodine | Saturated | +335 |
| Sodium Periodate | 5 | +596 |
| Sodium Vanadate | 5 | +125 |
| | 25 | +133 |
| Vanadium Pentoxide (EDTA) | 5 | +235 |
| | 25 | +240 |

EXAMPLE 2

Fully exposed film (a color positive type photosensitive film having an original silver coating weight of 50mg²/dm²) was developed in Eastman Kodak CD-3 developer (5 min.), washed, then bleached (5 min. in the appropriate solution), then fixed (Eastman-Kodak F-5 fixer), then washed and dried. The amount of silver remaining in the film was determined and recorded after this sequence of steps.[1] The results were as follows:

[1]This determination was made by X-ray fluorescent techniques and apparatus as described in Analytical Chemistry, Vol. 33, [No. 1] Jan. 1961 "Automatic Direct-Reading X-ray Spectroscopy - Application to Determination of Silver".

| Bleach Solution of Example 1 | Change in Redox | Silver Remaining |
|---|---|---|
| no bleach | | 50 (mg/dm²) |
| no additive | | 30 |
| hydroxylamine sulfate | −02 | 31 |
| cupric sulfate | +40 | 29 |
| sodium perchlorate | +60 | 15 |
| potassium iodate | +70 | 12 |
| sodium vanadate | +125 | 10 |
| sodium nitrate | +205 | 8 |
| iodine | +335 | 8 |
| potassium dichromate | +375 | 2 |
| potassium persulfate | +550 | 2 |
| sodium hypochlorite | +675 | 2 |

As can be seen from the above data, the process using inorganic bleach bath additives according to the present invention which raises the redox potential by at least 50 millivolts significantly reduces the amount of silver left in the photographic emulsion. This evidences an enhanced rate of bleaching for the bleach solution.

The silver in solution (mainly in fixer, but some exists in any wash baths used and other treatment baths) can then be recovered by known silver recovery techniques. Non-fixing bleach baths are preferred according to the practice of the present invention.

The bleach solutions of this invention when used in conventional color developing processes which comprise: (1) developing (contacting or immersing a color photographic element with a latent image into a developer solution, e.g., with a p-phenylenediamine), (2) bleaching, and (3) fixing (and probably a stop bath and intermediate wash baths), have been found to be effective bleach baths which do not reduce the sensitometric properties of the generated dye images.

What we claim is:

1. An aqueous non-fixing, ferricyanide free, oxidizing solution comprising 1. at least one water-soluble ferric compound which makes ferric ion available for the oxidation of silver,
2. halide ion, and
3. at least one water-soluble compound which releases an inorganic ion in aqueous solution which raises the redox potential of the solution comprising (1) and (2) at constant pH by at least 50 millivolts when present in a concentration not exceeding 50 g/liter, said water-soluble compound which releases an inorganic ion being selected from the class of chlorates, persulfates, perchlorates, iodates, periodates and hypochlorates.

2. The solution of claim 1 having a pH of from 0.25 – 9.0.

3. The solution of claim 1 wherein the ferric compound is ferric chloride.

4. The solution of claim 1 wherein the water-soluble compound which releases an inorganic ion is a persulfate.

5. A process for the conversion of metallic silver in a water-penetrable mass to silver halide comprising contacting the water-penetrable mass with an oxidizing solution comprising:

1. at least one water-soluble ferric compound which makes ferric ion available for the oxidation of silver,
2. halide ion, and
3. at least one water-soluble compound which releases an inorganic ion in aqueous solution which raises the redox potential of the solution comprising (1) and (2) at constant pH by at least 50 millivolts when present in a concentration not exceeding 50 g/liter, said water-soluble compound which releases an inorganic ion being selected from the class of chlorates persulfates, perchlorates, iodates, periodates and hypochlorates to oxidize the silver and form a silver halide.

6. A process for the removal of silver from a water-penetrable mass wherein the silver is present in an oxidized form which process comprises:

1. reducing the oxidized silver in the mass to metal silver
2. oxidizing the metallic silver by the process of claim 5 and
3. contacting the penetrable mass containing oxidized silver with a fixing solution to dissolve the silver halide.

7. The process of claim 6 wherein the water-soluble compound which releases an inorganic ion is a persulfate.

8. The process of claim 6 wherein the water-soluble compound which releases an inorganic ion is a chlorate.

9. The process of claim 6 wherein the solution has a pH of 0.25 – 9.0.

10. The process of claim 9 wherein the ferric compound is a ferric halide.

11. A process for the removal of silver from a water-penetrable mass containing silver in metallic form which comprises the process of claim 5 and thereafter 1. contacting the water-penetrable mass, containing silver halide resulting from the oxidation of metallic silver by the oxidizing solution, with a fixing solution to extract the silver into aqueous solution.

12. The process of claim 11 wherein the ferric compound is ferric halide.

13. The process of claim 5 wherein the ferric compound is ferric halide.

14. A process for the development of dye images in color photographic silver halide emulsions which comprises:

1. contacting a color photographic element with a color developer solution, thereafter
2. oxidizing metallic silver in the photographic element by the process of Claim 5, and then
3. fixing the photographic element to extract residual silver.

15. The process of claim 14 wherein the water-soluble compound which releases an inorganic ion is selected from the group consisting of chlorates, persulfates, perchlorates, hypochlorates, iodates, dichromates, periodates, vanadates, iodine and vanadium pentoxide.

16. The process of claim 15 wherein the water-soluble ferric compound is ferric chloride.

* * * * *